US009965933B1

(12) United States Patent
Schneider et al.

(10) Patent No.: US 9,965,933 B1
(45) Date of Patent: May 8, 2018

(54) PRODUCT STRAP DETECTION APPARATUS AND METHOD

(71) Applicant: CHECKPOINT SYSTEMS, INC., Thorofare, NJ (US)

(72) Inventors: Peter Schneider, Neckargemünd (DE); Haiming Gu, Shanghai (CN); Jianrui Zheng, Shanghai (CN); Jianjun Mei, Shanghai (CN)

(73) Assignee: Checkpoint Systems, Inc., Thorofare, NJ (US)

( * ) Notice: Subject to any disclaimer, the term of this patent is extended or adjusted under 35 U.S.C. 154(b) by 0 days. days.

(21) Appl. No.: 15/453,412

(22) Filed: Mar. 8, 2017

(51) Int. Cl.
*G08B 13/14* (2006.01)

(52) U.S. Cl.
CPC ..... *G08B 13/1463* (2013.01)

(58) Field of Classification Search
CPC ..... G08B 13/2434
USPC ..... 340/571, 572.1, 572.8, 572.9
See application file for complete search history.

(56) References Cited

U.S. PATENT DOCUMENTS

| | | | | |
|---|---|---|---|---|
| 7,522,048 | B2 | 4/2009 | Belden, Jr. | |
| 9,169,670 | B2 | 10/2015 | Shute et al. | |
| 9,404,291 | B1 | 8/2016 | White et al. | |
| 2008/0169924 | A1* | 7/2008 | Belden | E05B 73/0017 340/568.4 |
| 2011/0260594 | A1 | 10/2011 | Yang | |
| 2013/0169440 | A1 | 7/2013 | Bruhwiler et al. | |
| 2014/0077953 | A1 | 3/2014 | Yang | |

* cited by examiner

*Primary Examiner* — Kevin Kim
(74) *Attorney, Agent, or Firm* — McNair Law Firm, P.A.

(57) ABSTRACT

Devices, apparatuses, and methods for detecting product straps are provided. An example product security device for detecting product straps may include a base, and a pivot member affixed to the base via a first hinge. The pivot member may be configured to physically engage a strap to maintain the pivot member in a non-deflected position. The example device may further include a biasing member configured to urge the pivot member into a deflected position and a sensor configured to detect when the pivot member is in the deflected position. The sensor may be configured to, in response to detecting that the pivot member is in the deflected position, generate an alert signal. The example device may also include processing circuitry configured to receive the alert signal and, in response to receiving the alert signal, transmit an alert triggering signal to initiate an alert.

20 Claims, 11 Drawing Sheets

PRODUCT STRAP DETECTION APPARATUS AND METHOD

FIELD OF THE INVENTION

Embodiments of the present invention relate generally to loss prevention technologies and, more particularly, relate to systems, apparatuses, and methods for protecting articles, including retail products, from theft.

BACKGROUND OF THE INVENTION

Retail stores employ various loss prevention techniques to prevent and deter theft. One manner of addressing theft, is to secure a retail product with a device that alarms at the exit of the retail establishment if not removed first by store personnel during a purchasing transaction. Further, some of these devices alarm if attempts are made to tamper with or remove the devices from a product while the product is on the sales floor. While a variety of these types of devices have been implemented in retail settings, there continues to be demand for new devices that attach to products or otherwise protect products in new and unique ways.

BRIEF SUMMARY OF THE INVENTION

According to some example embodiments, an example product security device is provided. The example product security device may comprise a base and a pivot member affixed to the base via a first hinge. The pivot member may be configured to physically engage a strap to maintain the pivot member in a non-deflected position. The example product security device may also include a biasing member configured to urge the pivot member into a deflected position and a sensor configured to detect when the pivot member is in the deflected position. The sensor may be configured to, in response to detecting that the pivot member is in the deflected position, generate an alert signal. The example product security device may also include processing circuitry configured to receive the alert signal and, in response to receiving the alert signal, transmit an alert triggering signal to initiate an alert.

According to some example embodiments, an example apparatus is provided. The example apparatus may comprise a base and a movable member operably coupled to the base. The moveable member may be configured to engage a strap to maintain the moveable member in a non-deflected position. The example apparatus may also comprise a biasing member configured to urge the moveable member into a deflected position and a sensor configured to detect when the pivot member is in the deflected position. The sensor may be configured to, in response to detecting that the moveable member is in the deflected position, generate an alert signal. The example apparatus may further comprise processing circuitry configured to receive the alert signal and, in response to receiving the alert signal, transmit an alert triggering signal to initiate an alert.

According to some example embodiments, an example method is provided. The example method may comprise physically receiving a strap affixed to a product onto a pivot member via a sliding action to deflect the pivot member, against the urging of a biasing member, into a non-deflected position. The pivot member may be disposed between the strap and a surface of the product. The example method may further comprise moving the pivot member into a deflected position and into operable engagement with a sensor in response to the urging of the biasing member and a reduction in a tension on the strap; detecting, by the sensor, that the pivot member has moved into the deflected position and transmitting an alert signal; receiving, by the processing circuitry, an alert signal from the sensor; and transmitting an alert triggering signal to initiate an alert.

BRIEF DESCRIPTION OF THE DRAWINGS

Figure 1:
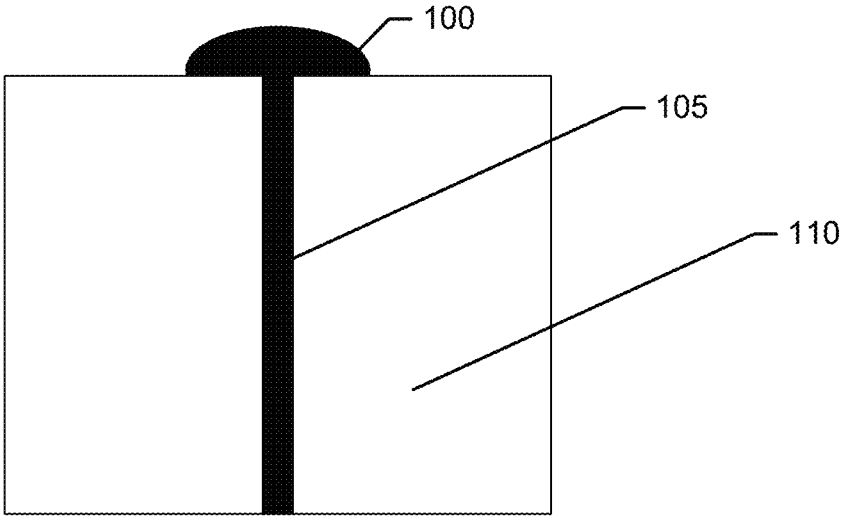
Figure 2:
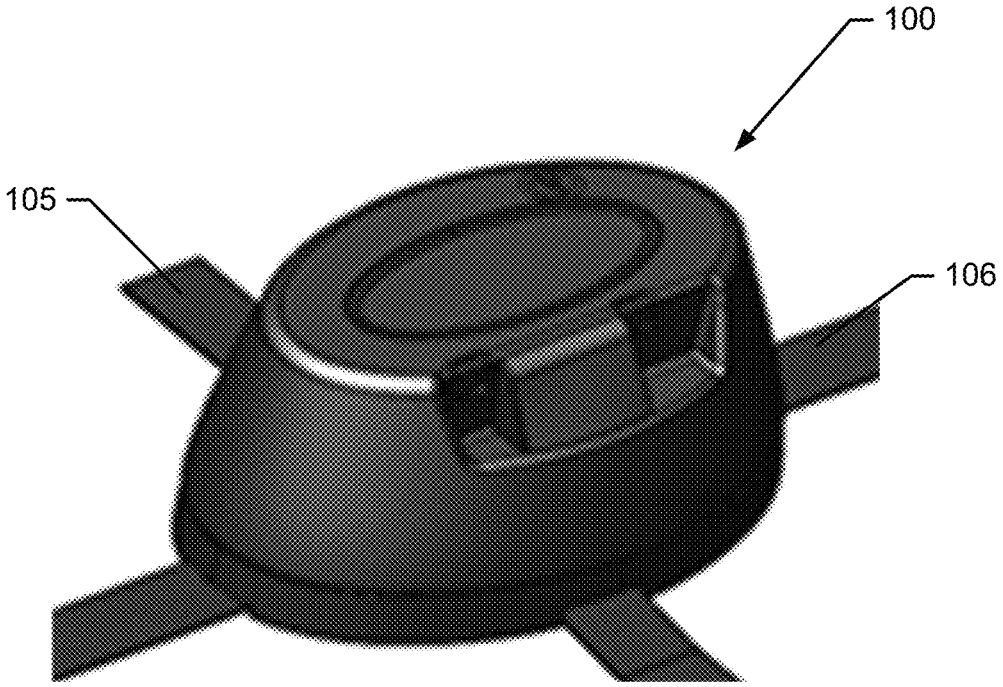
Figure 3:
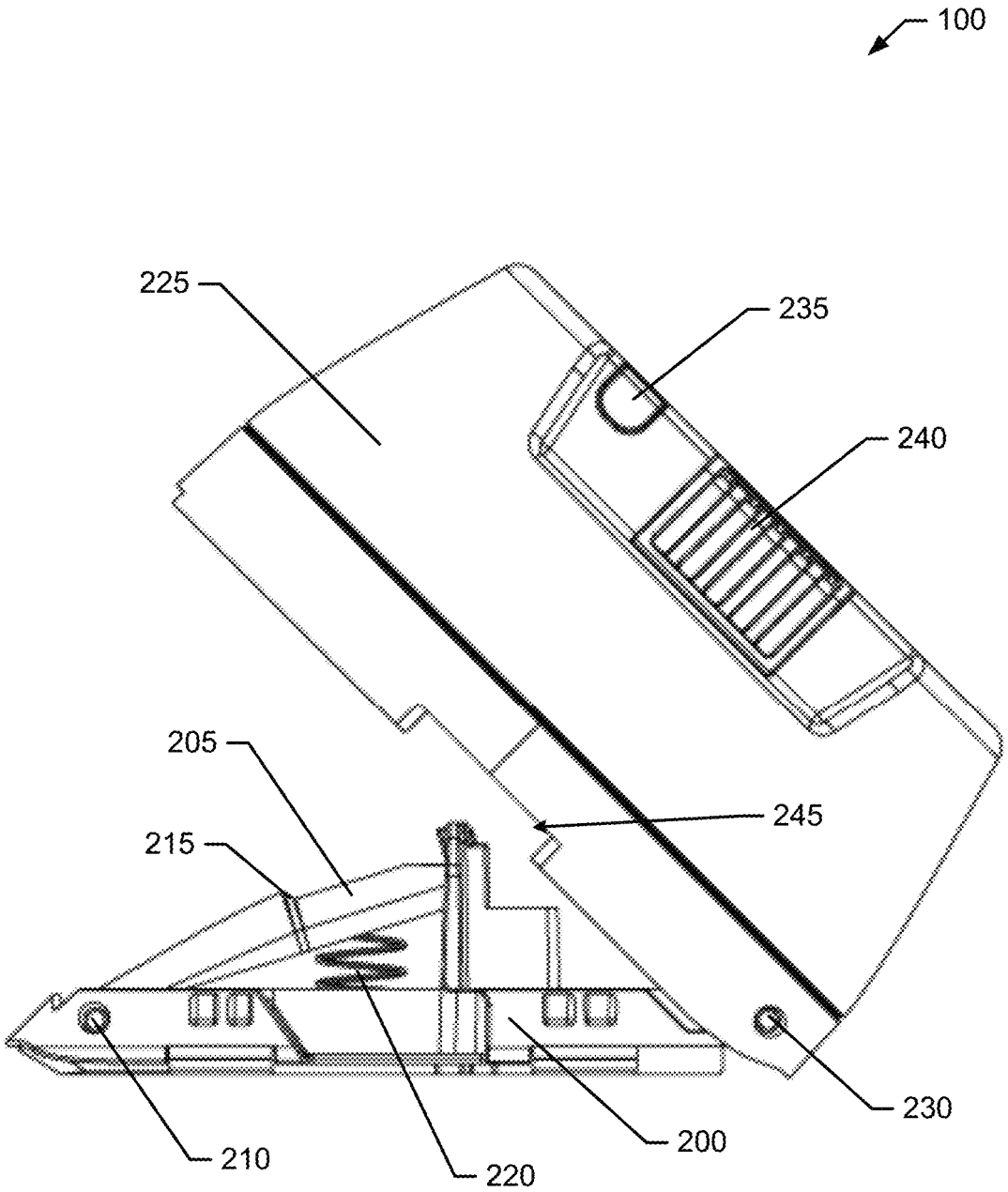
Figure 4:
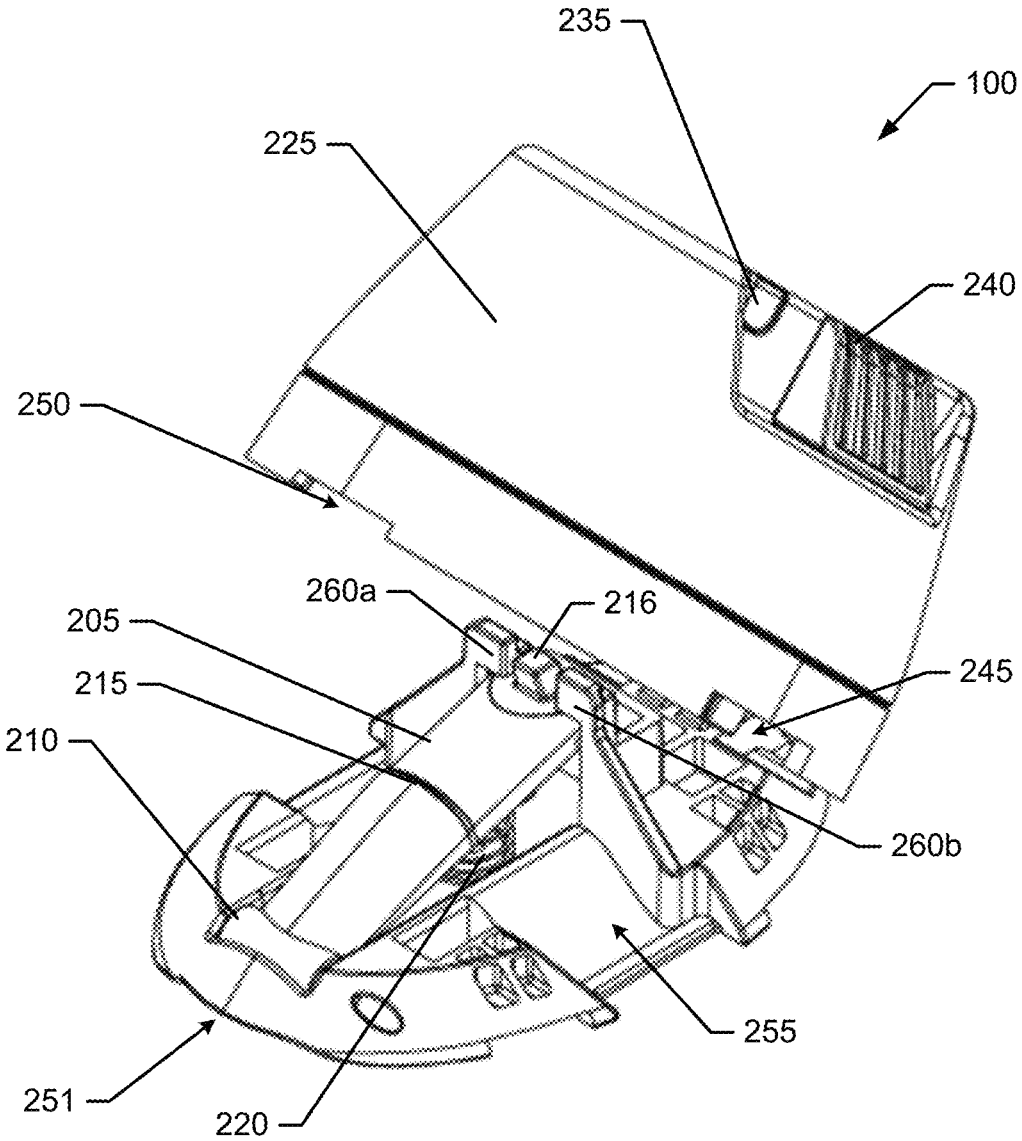
Figure 5:
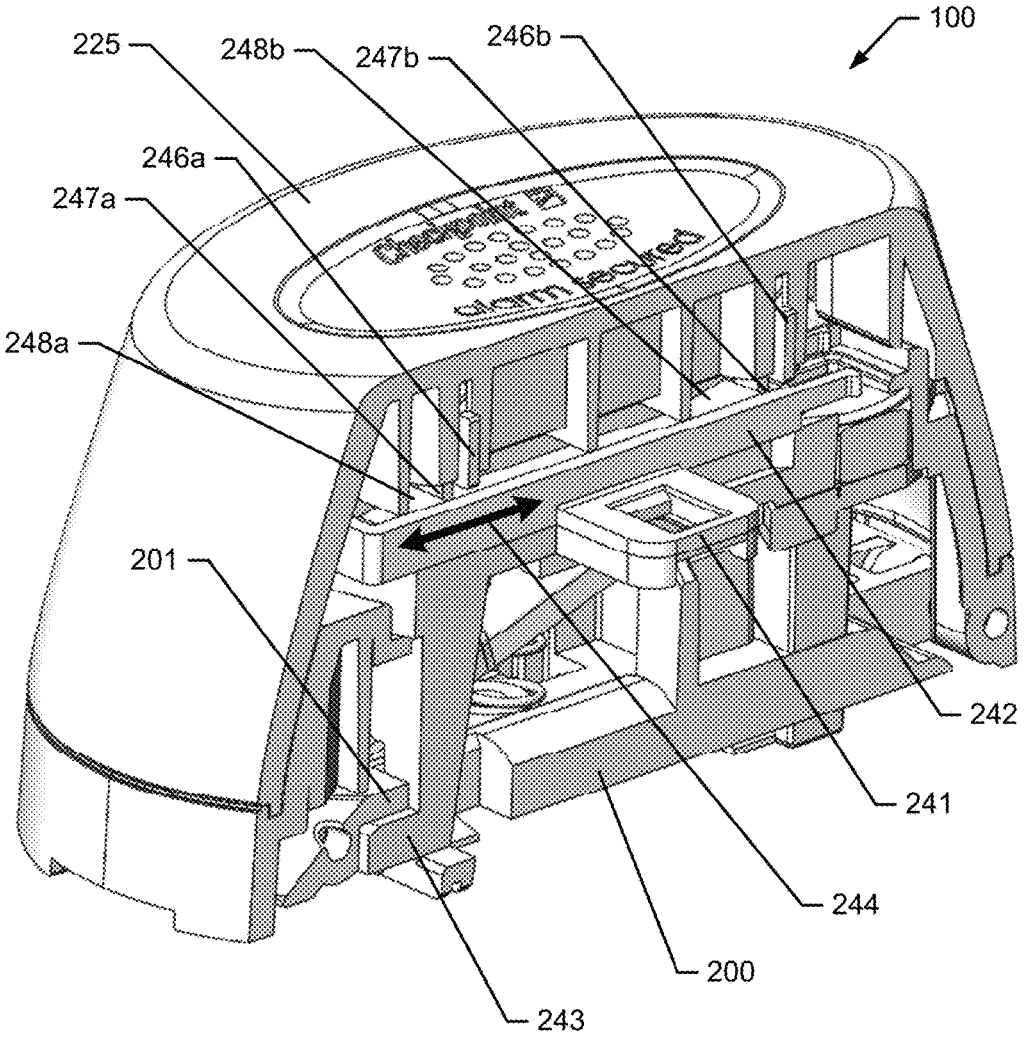
Figure 6:
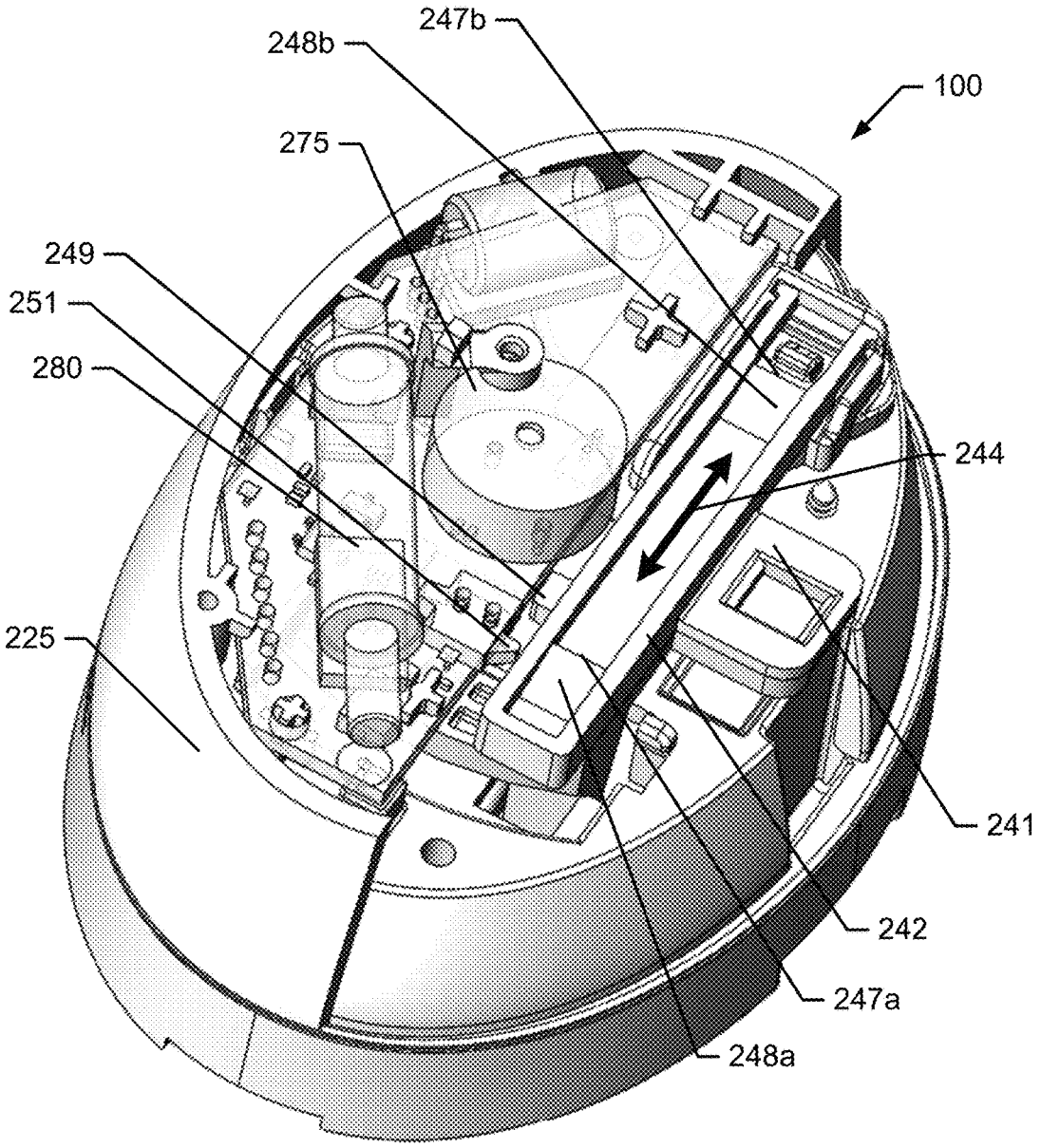
Figure 7:
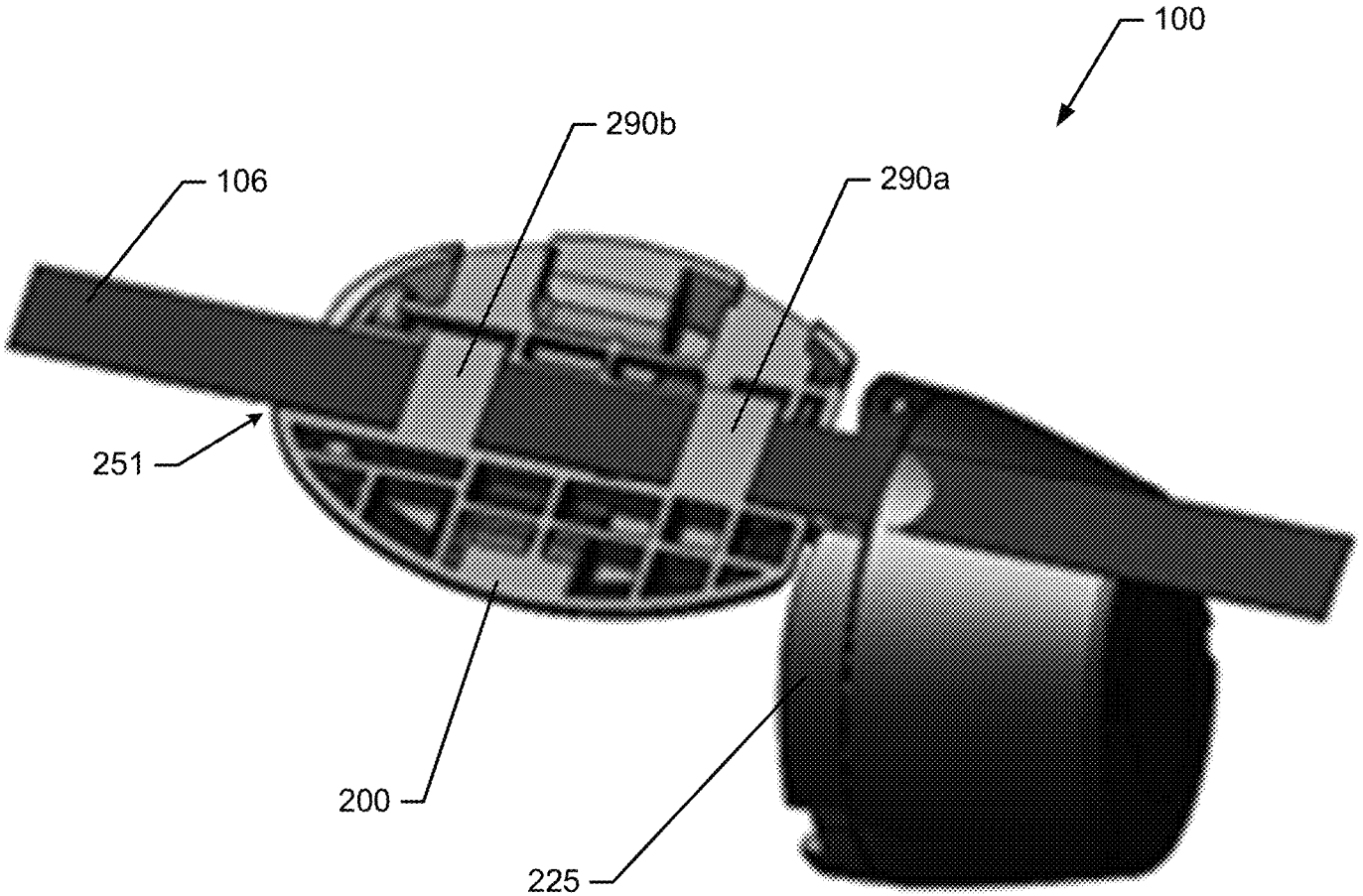
Figure 8:
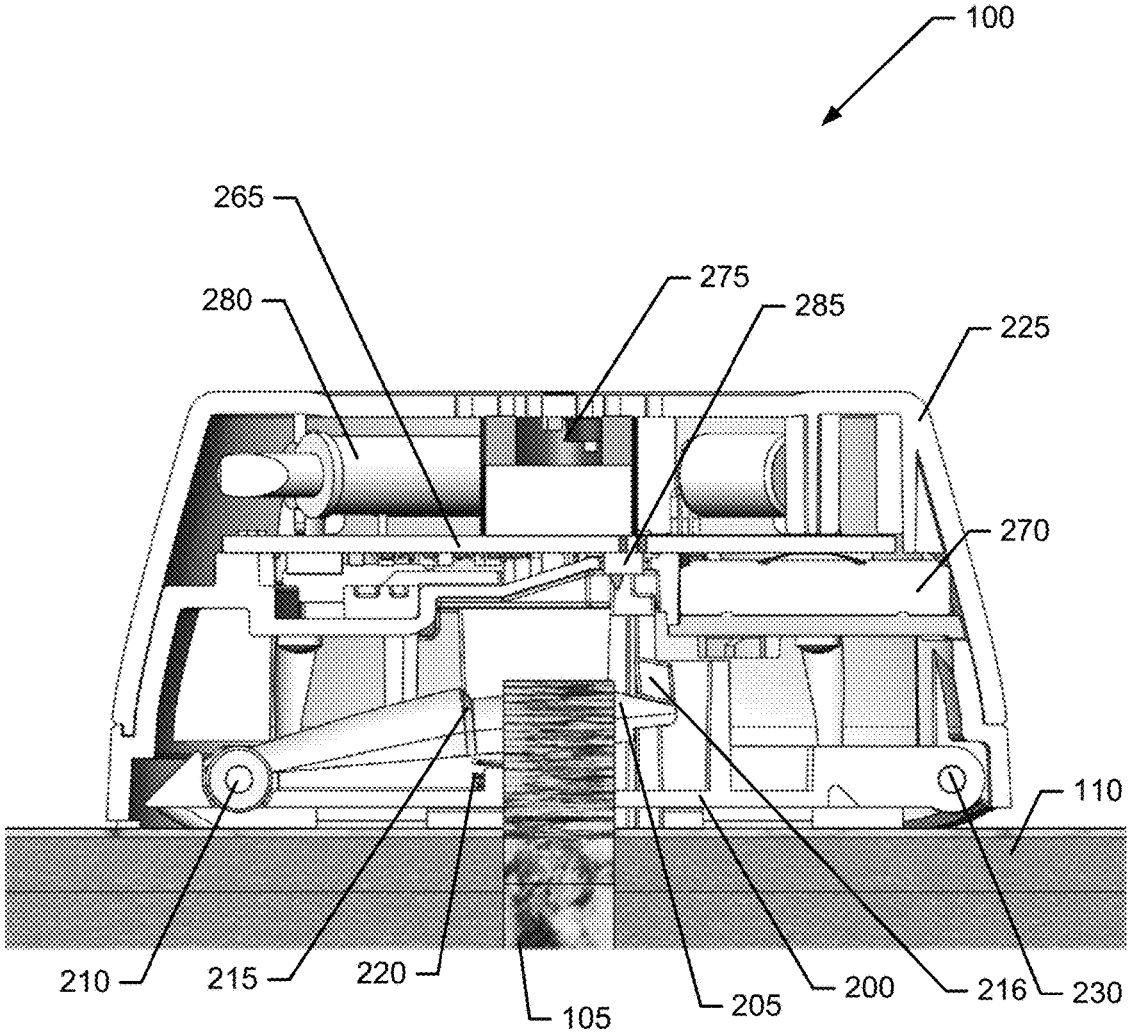
Figure 9:
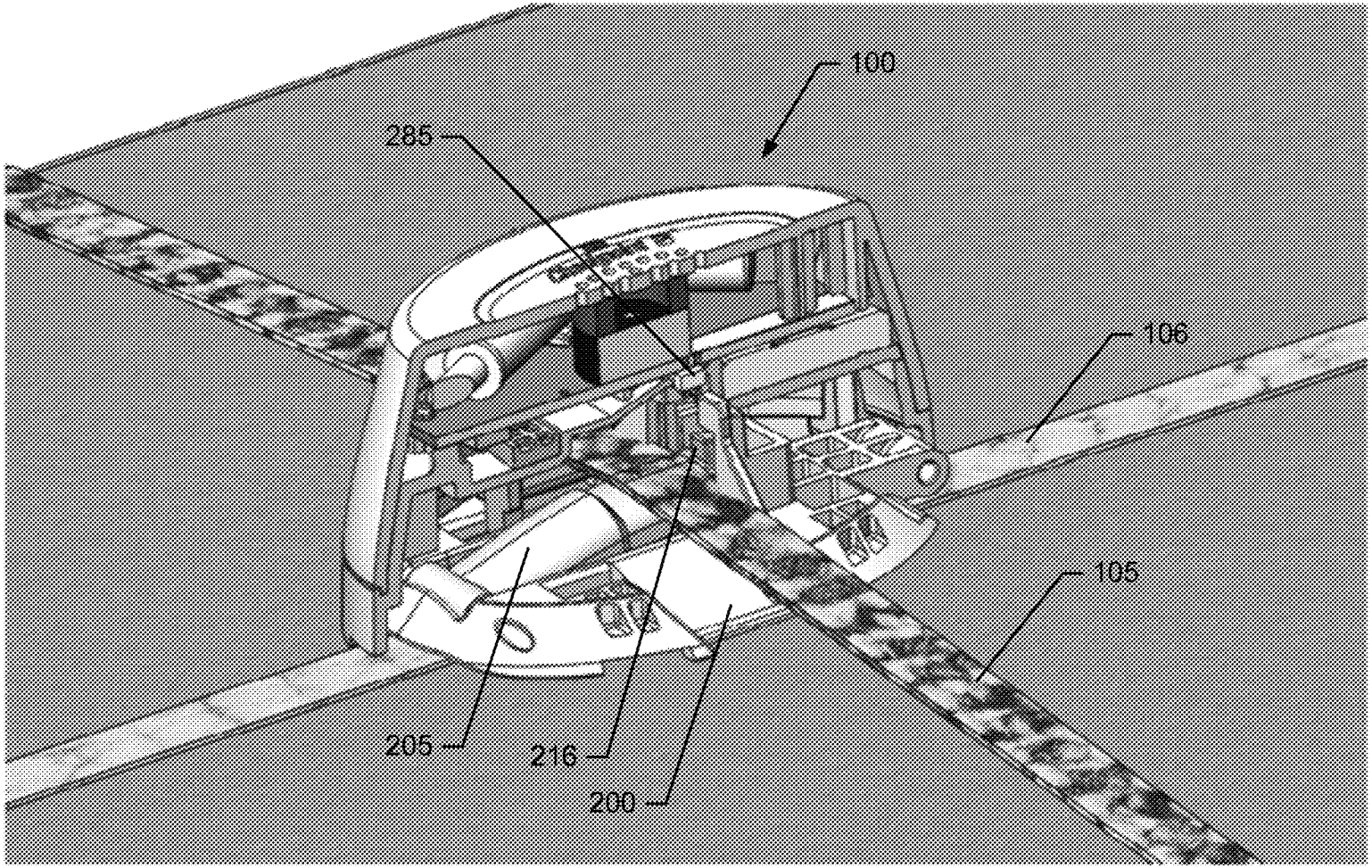
Figure 10:
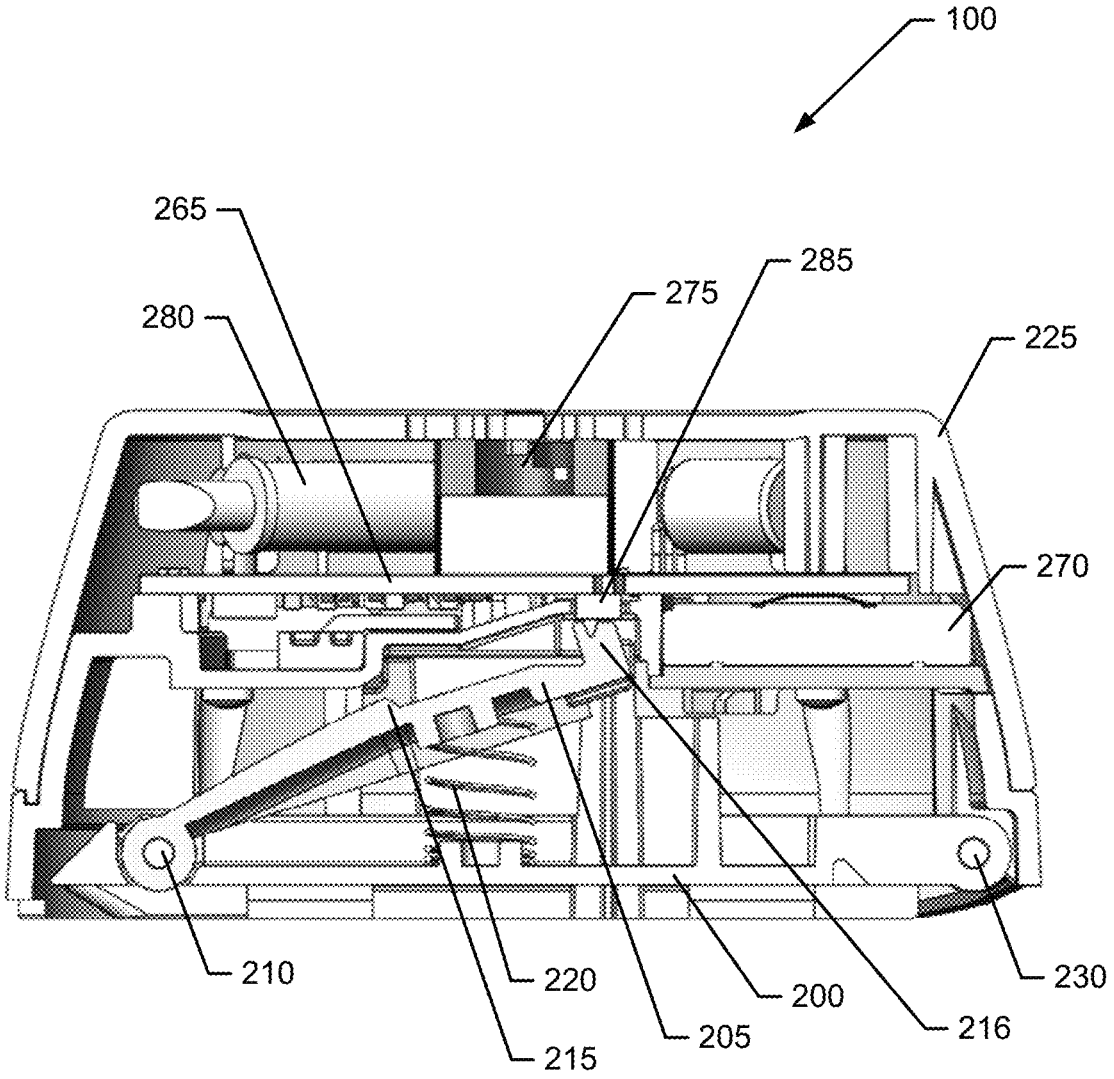
Figure 11:
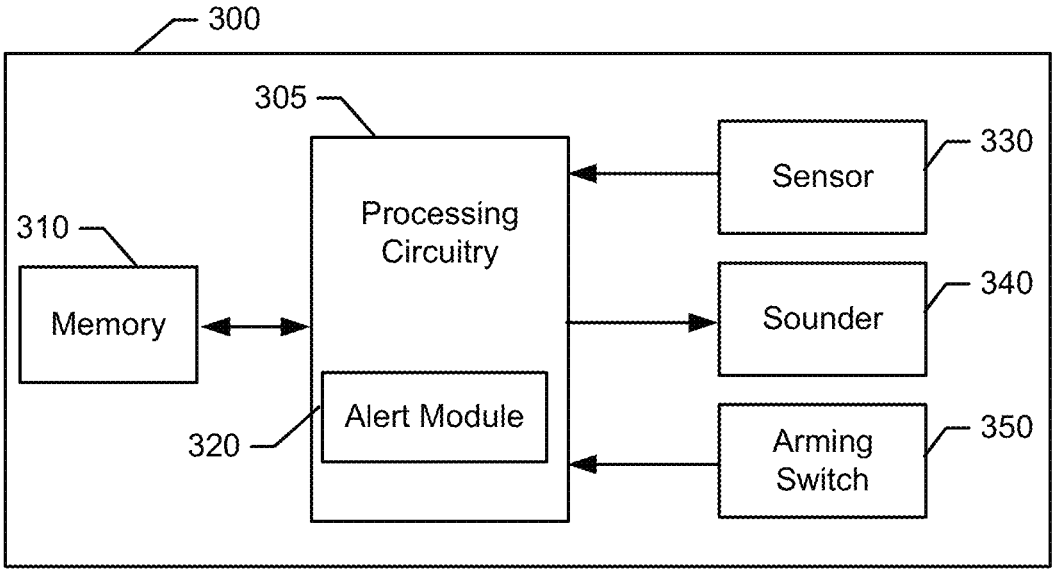
Figure 12:
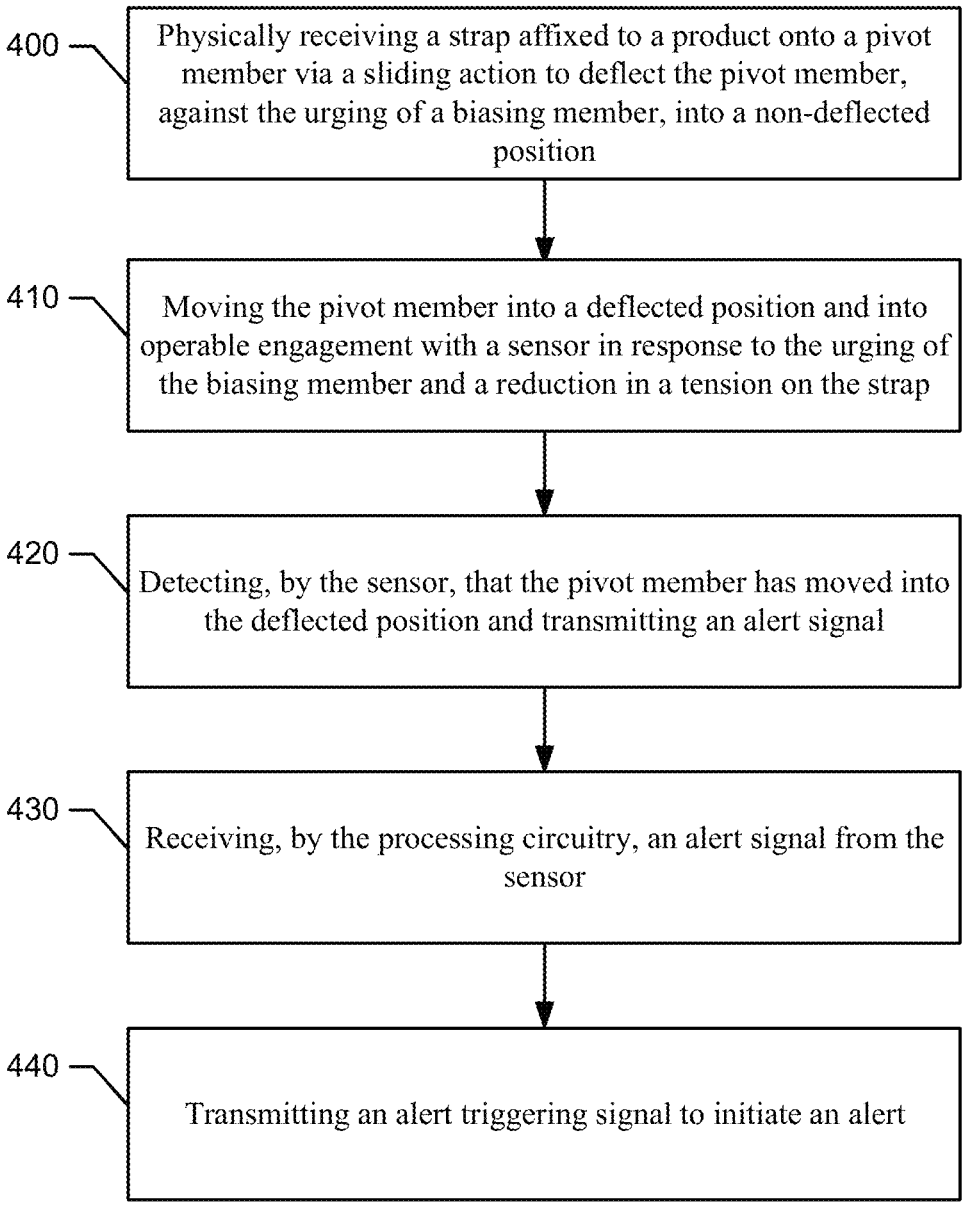

Having thus described some example embodiments in general terms, reference will now be made to the accompanying drawings, which are not necessarily drawn to scale, and wherein:

FIG. 1 shows a product security device affixed to a strap that is wrapped around a product in accordance with some example embodiments;

FIG. 2 shows a perspective view of a product security device affixed to two straps in accordance with some example embodiments;

FIG. 3 shows a side view of a product security device with a lid in an open position revealing internal components, in accordance with some example embodiments;

FIG. 4 shows a perspective view of a product security device with a lid in an open position revealing internal components in accordance with some example embodiments;

FIG. 5 shows a cross-section perspective view of a product security device with a lid in a closed position and a locking mechanism in a locked position in accordance with some example embodiments;

FIG. 6 shows a perspective view of a product security device with a portion of a lid cut away where the lid in a closed position and a locking mechanism in an unlocked position in accordance with some example embodiments;

FIG. 7 shows a bottom view of a base of a product security device with a lid in an open position in accordance with some example embodiments;

FIG. 8 shows a cross-section side view of a product security device with a lid in a closed position and a pivot member engaged with a strap in accordance with some example embodiments;

FIG. 9 shows a partial cross-section perspective view of a product security device with a lid in a closed position and a pivot member engaged with a first strap and a base engaged with a second strap in accordance with some example embodiments;

FIG. 10 shows a cross-section side view of a product security device with a lid in a closed position in accordance with some example embodiments;

FIG. 11 shows a block diagram of some electronic components of a product security device in accordance with some example embodiments; and FIG. 12 shows a block diagram of a method of operating a product security device in accordance with some example embodiments.

DETAILED DESCRIPTION

Exemplary embodiments will be described more fully hereinafter with reference to the accompanying drawings, in which some, but not all embodiments of the invention are shown. Indeed, the embodiments take many different forms and should not be construed as being limiting. Rather, these example embodiments are provided so that this disclosure will satisfy applicable legal requirements. Like reference numerals refer to like elements throughout.

Example embodiments are related to systems, apparatuses, and methods for detecting whether a strap affixed to a product (or product packaging) has been tampered with (e.g., severed or loosened) possibly in an attempt to remove the device from the product or remove the strap from the product. In this regard, many products (e.g., retail products) include one or more straps secured to the product. The straps can be applied for a variety of reasons, such as, for example, to discourage opening the product packaging in the store, to add strength to the product packaging, to hold the contents of the product packaging within product packaging, or even to be used as a handle to carry the product. Some example embodiments provide a device that can be installed on such a strap to protect the product from being stolen.

In this regard, a product security device affixed to the strap may include means for alerting store personnel (e.g., by sounding an audible alarm controlled by a security gate at an exit of the store or by alarming locally on the device) if the product is attempted to be removed from the store without the device first being detached from the strap during an purchasing transaction. Further, the device may include means for detecting that the strap has been tampered with, for example, by severing the strap to access the contents of the product packaging or remove the device from the product, or by loosening the strap in an effort to slide the strap off of the product. In response to detecting these activities, the product security device may be configured to alert or alarm. In this regard, example systems, apparatuses, and methods are provided, as further described herein, that support these and other functionalities.

FIG. 1 shows an example product security device 100, according to some example embodiments. In this regard, the product security device 100 is affixed to a strap 105, where the strap 105 is wrapped around the product 110. The strap 105 may be applied to the product 110 such that the strap 105 is under tension. The strap 105 is typically comprised of a plastic material with relatively low elasticity. The product 110 may also have a strap applied laterally across the top of the product 110 (not shown in FIG. 1). As such, a product 110 may have any number of straps applied, and straps may be applied in different orientations resulting in locations where two straps intersect. In this regard, FIG. 2 shows a closer perspective view product security device 100 affixed the strap 105 at an intersection with a second strap 106 in accordance with some example embodiments. The product security device 100 is show being engaged with both strap 105 and strap 106.

FIG. 3 shows a side view of a product security device 100 with a lid 225 in an open position revealing internal components in accordance with some example embodiments. Similarly, FIG. 4 shows a perspective view of a product security device 100 with the lid 225 in an open position revealing internal components in accordance with some example embodiments. With reference to these figures, the product security device 100 includes a base 200 and a lid 225. The base 200 may be formed as, for example, as a generally flat plate that a number of components may be affixed to in order to support the functionality of the product security device 100.

A pivot member 205 (also more generally referred to as a movable member) may be affixed to the base 200 via a hinge 210. The hinge 210 may permit the pivot member 205 to swivel or pivot relative to the base 200 between a deflected position (as positioned in FIG. 3) and non-deflected positions, as further described herein. The pivot member 205 may be urged or forced upward into the deflected position by a biasing member 220 (e.g., a spring). According to some example embodiments, the pivot member 205 may be configured to physically engage a strap (e.g., strap 105) to maintain the pivot member in a non-deflected position when installed on a product. According to some example embodiments, the pivot member 205 may also include a raised lip 215 positioned on an upper surface of the pivot member 205 that may function to hold a strap on the pivot member 205 and inhibit the strap from sliding. In this regard, the lip 215 may engage a strap to maintain the strap on the pivot member 205. Additionally, the base 200 may, according to some example embodiments include strap channel 255 located adjacent to and on both sides of the pivot member 205 and the lip 215 on an upper surface of the base 200. The strap channel 255 may have walls that operate to maintain a strap engaged with the pivot member 205 within the strap channel 255 when the product security device 100 is affixed to the strap. Further, the pivot member 205 may include a protrusion 216 disposed, for example, on an end of the pivot member 205 opposite the hinge 210. The protrusion 216 may be configured to engage a sensor that detects when the pivot member 205 is in the deflected position as further described herein.

According to some example embodiments, the base 200 may also include stops 260*a* and 260*b*. The stops may be disposed at a location that prevents the pivot member 205 from pivoting beyond the deflected position away from the base 200. In this regard, the biasing member 220 may operate to force the pivot member 205 to pivot in an upward direction and away from the base 200 and into the deflected position where further movement of the pivot member 205 is prevented by the stops.

Note that while example embodiments described herein make reference to pivot member 205, it is contemplated that a more general moveable member may be utilized that, for example, translates between non-deflected positions and the deflected position. Such an implementation is an alternative to having a pivot member affixed via a hinge to the base that moves in a pivoting manner.

The lid 225 may be affixed to the base 200 via a hinge 230. Hinge 230 may permit the lid to swivel or pivot relative to the base 200 between an open position (as shown in FIG. 3) and a closed position (as shown in FIG. 2). The lid 225 may include a hollow opening or cavity that can cover the base 200 and the pivot member 205, when the lid 225 is in the closed position. In this regard, when the lid 225 is in the closed position, the lid 225 may operate to prevent access to the pivot member 205 and prevent access to an engagement between the pivot member 205 and a strap to inhibit tampering. In this regard, the lid 225 may take the form of a hood that encases and encloses the base 200 by being in direct contact with the surface of the product, except from beneath. Additionally, the hinge 230 may be disposed adjacent to one end (e.g., a rear end) of the base 200 and the hinge 210 may be disposed adjacent to the other end (e.g., a forward end) of the base 200.

The lid 225 may also house electronics and other components within the lid 225's cavity. For example, the lid 225 may house a locking mechanism that operates to lock the lid 225 to the base 200 to secure the product security device 100 to a product via a strap disposed between the lid 225 and the base 200. The locking mechanism may include a slider 240 that may slide between an armed position and an unarmed position. In the armed position, the slider 240 may be operatively connected to a movable lock member that may engage with a lock feature to lock the lid 225 to the base 200. According to some example embodiments, the movable lock member may be housed in the lid 225 and the lock feature may be disposed on the base 200. When the slider 240 is in the unarmed position, the movable lock member may be disengaged from the lock feature to permit the lid 225 to be moved into the open position to, for example, remove the product security device 100 from the strap.

Slider 240 may be operably connected to or engage, directly or indirectly, an arming switch (e.g., arming switch 251). The arming switch may be configured to transition the product security device 100 into an armed state in response to the slider 240 being moved into the armed position, and into an unarmed state in response to the slider 240 being moved into the unarmed position.

Additionally, the lid 225 may include one or more key locators 235. The key locator 235 may be a visual and physical guide to assist a user in placement of a magnetic key on the lid 225 to unlock the slider 240 and permit slider 240 to move. Thus, according to some example embodiments, the locking mechanism may be configured to operatively couple to a magnetic key to permit the movable lock member to disengage from the lock feature to unlock the lid 225 from the base 200.

In this regard, FIG. 5 shows a cross-section perspective view of a product security device 100 with a lid 225 in a closed position and a locking mechanism in a locked position, in accordance with some example embodiments. According to some example embodiments, the slider 240 may be operably connected to slider seat 241 to operate a slider assembly of the locking mechanism. In this regard, the slider seat 241 may be the feature of the locking mechanism that transfers the force applied to the slider 240, e.g., by a user's finger, to the associated components of the locking mechanism to transition the locking mechanism between locked and unlocked positions. In this regard, the slider seat 241 may be operably connected to slider bar 242 and locking protrusion 243, which, with slider 240 and the slider seat 241, may be collectively referred to as the slider assembly. As indicated by arrow 244, the slider assembly may slide between a locked position (as depicted in FIG. 5) where the locking protrusion 243 engages catch 201 of the base 200 to prevent the lid 225 from pivoting into the open position relative to the base 200, and an unlocked position where the locking protrusion 243 does not engage the catch 201 of the base 200 and permits the lid 225 to pivot into the open position relative to the base 200.

The slider bar 242 may include features on a surface, e.g., upper surface, of the slider bar 242 to latch the slider assembly into the locked position. In this regard, the slider bar 242 may include latch stops 247*a* and 247*b*, respectively, and the latch ramps 248*a* and 248*b*, respectively. The latch ramps 248 and the latch stops 247 may be positioned to engage locking slugs 246*a* and 246*b*, respectively, which are biased (e.g., by springs) in a direction towards the latch stops 247. In operation, as the slider bar 242 moves from the unlocked position towards the locked position, the locking slugs 246 will ride up the slider ramps 248 until the locking slugs 246 reach the latch stops 247. When the locking slugs 246 move past the latch stops 246, the locking slugs 246 will transition into a latched position (e.g., downward) that prevents movement of the slider bar 242 towards the unlocked position due to a stopping engagement with the latch stops 246. Additionally, when the locking slugs 246 move past the latch stops 246, the locking protrusion 243 will be engaged with the catch 201.

According to some example embodiments, to permit the slider bar 242 to move back to the unlocked position, the locking slugs 246 can be removed from engagement with the latch stops 246. To do so, the locking slugs 246 may be moved upwards (e.g., towards a roof of the lid 225) to avoid engagement with the latch stops 247 when the slider assembly is moved to the unlocked position. Because the locking slugs 246 may include or be made of a ferrous material or metal, a magnet (e.g., installed in a key) may be used to move the locking slugs 246 to avoid engagement with the latch stops 247.

FIG. 6 shows an additional perspective view of the product security device 100 with a portion of the lid 225 cut away. In FIG. 6, it can be seen that the slider bar 242 is disposed in the unlocked position. Additionally, FIG. 6 shows, according to some example embodiments, a slider tab 249 and an arming switch 251. In this regard, it can be seen that as the slider bar 242 moves into the locked position, slider tab 249 may engage with and actuate arming switch 251 to place the product security device 100 in the armed state as further described herein. Similarly, when slider bar 242 moves into the unlocked position, the slider tab 249 may disengage with the arming switch 251 and cause the arming switch 251 to again actuate to thereby place the product security device 100 in the unarmed state as further described herein.

Referring back to FIG. 4, the lid 225 may also include cutouts 245. Each cutout 245 may be positioned to align with the strap channel 255 to engage a strap and hold the strap in position when the lid 225 is in the closed position and the strap is engaged with the pivot member 205. Thus, the cutouts 245 may be configured to engage the strap 105 in response to the strap 105 being engaged with the pivot member 205 and the lid 225 being in the closed position. Additionally, the lid 225 may include other cutouts 250 that are located on the forward and rear ends of the lid 225 for engagement with a second strap. As described with respect to FIG. 2, the product security device 100 may engage a second strap that is substantially perpendicular to the first strap. The second strap may be engaged into a strap channel 251 located on a bottom surface of the base 200. Each cutout 250 may be positioned to align with the strap channel 251 to engage a strap and hold the strap in position when the lid 225 is in the closed position. With reference to FIG. 7, which shows a bottom view of the base 200 in accordance with some example embodiments, clips 290*a* and 290*b* may be disposed within the strap channel 251 to secure the second strap 106 to the product security device 100. In this regard, the clips 290*a* and 290*b* may physically connected to the base 200 on one side to permit the strap 106 to slide onto the clips 290*a* and 290*b* via an opening located opposite to the physical connections.

FIG. 8 shows a cross-section side view of a product security device 100 with the lid 225 in the closed position and the pivot member 205 engaged with the strap 105, in accordance with some example embodiments. The cross-section view reveals additional components that may be housed in the lid 225. In this regard, the lid 225 may house electronic circuitry that may be affixed to a circuit board 265. The circuit board may support processing circuitry (not shown in FIG. 8) that may control the functionality of the product security device 100 as further described with respect to FIG. 11 and as otherwise described herein. The circuit board 265 may be operably connected to a battery 270 that may supply electrical power to the circuit board 265 and other electrical components of the product security device 100.

The circuit board 265 may support, for example, a radio frequency (RF) resonant device 280. The RF resonant device 280 may be an LC circuit configured to receive an RF signal from a security gate, for example, located at an exit of a retail store and generate a responsive signal that may be detected by the security gate. The security gate may be configured to receive the responsive signal and, in response, generate an alarm to notify store personnel that a theft may be occurring. According to some example embodiments, a processing circuitry may be configured to monitor the RF resonant device 280 and sound a local alarm (e.g., via sounder 275) if the processing circuitry detects that the RF resonant device 280 has received a signal from a security gate. The RF resonant device 280 may resonate in response to a security gate that generates, for example, a 4.8 MHz or 58 kHz signal.

As mentioned above, the lid 225 may house a sounder 275 that may be operably connected to the circuit board 265. The sounder 275 may be configured to emit an audible sound in response to receiving a signal from, for example, processing circuitry. The sounder 275 may be any type of speaker or other device capable of generating an audible sound, such as, for example, a piezoelectric transducer.

The circuit board 265 may also support a sensor 285. The sensor 285 may be positioned and configured to detect when the pivot member 205 is moved into the deflected position. According to some example embodiments, the sensor 285 may be disposed at a location above the pivot member 205. The sensor 285 may be any type of sensor capable of detecting the presence of the pivot member 205 in the deflected position. In some example embodiments, the sensor 285 may be a push button switch. In this regard, the switch may include an actuator that physically engages with the pivot member 205, and more specifically, according to some example embodiments, the protrusion 216 of the pivot member 205, to operate the switch when the pivot member 205 is in the deflected position. According to some example embodiments, the sensor 285 may only engage with the pivot member 205 when the pivot member 205 is in the deflected position. In this regard, the pivot member 205 may be placed in a variety of non-deflected positions (e.g., due to variations in the tension on a strap that is engaged with the pivot member 205), but the sensor 285 may only detect pivot member 205 when the pivot member 205 is in the deflected position. Accordingly, when the pivot member 205 is engaged with a strap that is applying a downward force on the pivot member 205, the pivot member 205 is not engaged with the sensor 285. In this manner, the product security device 100 may not be sensitive to relatively slight variations in strap tension.

In FIG. 8, the product security device 100 is shown with the strap 105 engaged with the pivot member 205. Due to the force being applied on the pivot member 205, against the urging of the biasing member 220, the pivot member 205 is in a non-deflected position. To obtain this configuration, the base 200 of the product security device 100, with the lid 225 in the open position, may be slid under the strap 105 such that the base 200 and the pivot member 205 are disposed between the strap 105 and the product 110. As the base 200 is slid under the strap 105, the strap 105 may begin to engage with the pivot member 205 and slid up onto the pivot member 205. At the same time, because the strap is under tension, sliding of the strap 105 further may move the pivot member 205 out of the deflected position as the strap 105 rides up the pivot member 205. The strap 105 may continue to slide onto the pivot member 205 until, for example, the strap 105 passes the lip 215 and rests in the strap channel 255. As such, the pivot member 205 may be configured to move into the non-deflected position responsive to the strap 105 sliding onto the pivot member 205 to depress the pivot member 205 away from the deflected position and against the urging of the biasing member 220. Subsequently, the lid 225 may be moved into the closed position and the slider 240 may be moved into the armed position to arm the product security device 100. According to some example embodiments, the lid 225 may include one or more ribs that engage with an hold the strap 105 in position, when the lid 225 is moved into the closed position. The pivot member 205 may therefore be in a non-deflected position where the pivot member 205 is not engaged with the sensor 285. With the product security device 100 in the armed state, if the strap 105 is cut or if tension is otherwise removed from the strap 105 to permit the pivot member 205 to move into the deflected position, then the sensor 285 may detect the presence of the pivot member 205 in the deflected position. As further described with respect to FIG. 11, the sensor 285, having detected the engagement with the pivot member 205, may transmit an alert signal to, for example, a processing circuitry to direct the processor to initiate an alert, such as, by triggering the sounder 275 to emit an audible sound.

FIG. 9 shows a partial cross-section perspective view of a product security device 100 with the lid 225 in the closed position and the pivot member 205 engaged with a first strap 105 and the base 200 engaged with a second strap 106 in accordance with some example embodiments. In this regard, the first strap 105 is shown as holding the pivot member 205 in a non-deflected position as described with respect to FIG. 8. Further, the product security device 100 is shown with the second strap 106 engaged with the base 200 on a bottom side of the base as described with respect to FIG. 7.

FIG. 10 shows a cross-section side view of a product security device 100 with the lid 225 in the closed position, but the pivot member 205 is no longer in engagement with the strap 105. In this regard, for example, the strap 205 may have been severed and removed from the product security device 100 in an attempt to steal the product that the product security device 100 was affixed to. Since the strap 105 is no longer holding the pivot member 205 in a non-deflected position, the biasing member 220 can force the pivot member 205 into the deflected position and into engagement with the sensor 285, as shown in FIG. 10. The sensor 285 may therefore provide an alert signal which may result in, for example, the sounder 275 emitting an audible alarm sound.

FIG. 11 shows a block diagram of some example electronic components of a product security device 300 in accordance with some example embodiments. The product security device 300 may operate in the same, or in a similar manner, to the product security device 100. Further, it is understood that the functionalities described with respect to the product security device 300, may be implemented within the context of the product security device 100.

The product security device 300 may include processing circuitry 305 (which may include a processor) and a memory 310. According to some example embodiments, the processing circuitry 305 may be an operable assembly of passive or active electronic components configured together to perform the functionalities of the processing circuitry described herein. Such passive components may include mere wiring between active elements, resistors, capacitors, inductors, or the like. Further, the processing circuitry 305 may be any means configured to execute various programmed operations or instructions stored in a memory device (e.g., memory 310) such as a device or circuitry operating in accordance with software or otherwise embodied in hardware or a combination of hardware and software (e.g., a processor operating under software control or the processors embodied as an application specific integrated circuit (ASIC) or field programmable gate array (FPGA) specifically configured to perform the operations described herein, or a combination thereof) thereby configuring the device or circuitry to perform the corresponding functions of the processing circuitry 305 as described herein. In this regard, the processing circuitry 305 may be configured to analyze electrical signals communicated thereto, for example in the form of signals received from the sensor 330 or the arming switch 350 and modify operation of the product security device 300 in accordance with the functionalities of an alert module 320. The memory 310 may be configured to store instructions, computer program code, and other data in a non-transitory computer readable medium for use, such as by the processing circuitry 305.

As mentioned above, the processing circuitry 305 may be configured to implement an alert module 320 to perform the various functions described herein. Further, the processing circuitry 305 may be operably connected to various components, some of which include, a sensor 330, a sounder 340, and an arming switch 350. The sensor 330 may be the same or similar to the sensor 285 described above. The sounder 340 may be the same or similar to the sounder 275 described above. Finally, the arming switch 350 may be same or similar to the arming switch 251 and as otherwise described above.

According to some example embodiments, the alert module 320 may configure the processing circuity 305 to perform various functionalities. As described herein, the sensor 330 may be configured to, in response to detecting that a pivot member is in a deflected position, generate an alert signal. The processing circuitry 305 may be configured to, through implementation of the alert module, receive the alert signal from the sensor 330 and, in response to receiving the alert signal, transmit an alert triggering signal to initiate an alert. Transmission of the alert triggering signal may include being configured to transmit the alert triggering signal to the sounder 340 to cause the sounder 340 to generate an audible sound.

Further, the processing circuitry 305 may also be configured via the alert module 320, to perform functionalities in relation to the arming switch 350. In this regard, arming switch 350 may be configured to transition the product security device 300 between an armed state and an unarmed state. In the armed state, the processing circuitry 305 may be configured to monitor the sensor 330 to determine if the tension on the strap 105 has been reduced (e.g., via a severing event) to a threshold tension where a pivot member moves into the deflected position. Further, in the unarmed state, the processing circuitry 305 may be configured to deactivate sensor 330, and possibly other components, and thereby not detect when the pivot member is in the deflected position.

FIG. 12 shows a block diagram of a method of operating a product security device in accordance with some example embodiments. The example method of FIG. 12 includes, at 400, physically receiving a strap affixed to a product onto a pivot member via a sliding action to deflect the pivot member, against the urging of a biasing member, into a non-deflected position. In this regard, the pivot member may be disposed between the strap and a surface of the product. The example method may further include, at 410, moving the pivot member into a deflected position and into operable engagement with a sensor in response to the urging of the biasing member and a reduction in a tension on the strap, for example, due to severing of the strap. At 420, the example method may include, detecting, by the sensor, that the pivot member has moved into the deflected position and transmitting an alert signal responsive to the detecting. At 430, the example method may further include receiving, by the processing circuitry, an alert signal from the sensor, and, at 440, transmitting an alert triggering signal to initiate an alert. According to some example embodiments, transmitting the alert triggering signal may include transmitting the alert triggering signal to a sounder to cause the sounder to generate an audible sound.

As used herein, the term "module" is intended to include a computer-related entity, such as but not limited to hardware, firmware, or a combination of hardware and software. For example, a module may be, but is not limited to being a software or hardware implementation of a process, an object, an executable, and/or a thread of execution, which may be implemented via a processor or computer. By way of example, both an application running on a computing device and/or the computing device can be a module. One or more modules can reside within a process and/or thread of execution and a module may be localized on one computer and/or distributed between two or more computers. In addition, these modules can execute from various computer readable media having various data structures stored thereon. The modules may communicate by way of local and/or remote processes such as in accordance with a signal having one or more data packets, such as data from one module interacting with another module in a local system, distributed system, and/or across a network such as the Internet with other systems by way of the signal. Each respective module may perform one or more functions that will be described in greater detail herein. However, it should be appreciated that although this example is described in terms of separate modules corresponding to various functions performed, some examples need not necessarily utilize modular architectures for employment of the respective different functions. Thus, for example, code may be shared between different modules, or the processing circuitry itself may be configured to perform all of the functions described as being associated with the modules described herein. Furthermore, in the context of this disclosure, the term "module" should not be understood as a nonce word to identify any generic means for performing functionalities of the respective modules. Instead, the term "module" should be understood to be a modular entity that is specifically configured in, or can be operably coupled to, processing circuitry to modify the behavior and/or capability of the processing circuitry based on the hardware and/or software that is added to or otherwise operably coupled to the processing circuitry to configure the processing circuitry accordingly.

Many modifications and other embodiments of the inventions set forth herein will come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

What is claimed is:

1. A product security device comprising:

a base;

a pivot member affixed to the base via a first hinge, the pivot member being configured to physically engage a strap to maintain the pivot member in a non-deflected position;

a biasing member configured to urge the pivot member into a deflected position;

a sensor configured to detect when the pivot member is in the deflected position, wherein the sensor is configured to, in response to detecting that the pivot member is in the deflected position, generate an alert signal; and processing circuitry configured to receive the alert signal and, in response to receiving the alert signal, transmit an alert triggering signal to initiate an alert.

2. The product security device of claim 1, further comprising a sounder, and wherein the processing circuitry configured to transmit the alert triggering signal includes being configured to transmit the alert triggering signal to the sounder to cause the sounder to generate an audible sound.

3. The product security device of claim 1, wherein the pivot member is configured to move into the non-deflected position responsive to the strap sliding onto the pivot member to depress the pivot member away from the deflected position against the urging of the biasing member.

4. The product security device of claim 1, wherein the pivot member includes a raised lip configured to engage and maintain the strap on the pivot member.

5. The product security device of claim 1, further comprising a lid affixed to the base via a second hinge, the lid being configured to prevent access to the pivot member when the lid is in a closed position.

6. The product security device of claim 5, wherein the first hinge is disposed adjacent a first end of the base and the second hinge is disposed adjacent a second end of the base, the first end of the base being opposite the second end of the base.

7. The product security device of claim 5, wherein the lid includes cutouts configured to engage the strap in response to the strap being engaged with the pivot member and the lid being in the closed position.

8. The product security device of claim 5, further comprising a locking mechanism comprising a movable lock member that engages a lock feature to lock the lid to the base.

9. The product security device of claim 5, wherein the locking mechanism is configured to operatively couple to a magnetic key to permit the movable lock member to disengage from the lock feature to unlock the lid from the base.

10. The product security device of claim 1, wherein the base includes a channel on a bottom side of the base, the channel configured to engage a second strap.

11. The product security device of claim 1, wherein the sensor is a push button switch.

12. The product security device of claim 1, wherein the pivot member includes a protrusion configured to engage the push button switch when the pivot member is in the deflected position.

13. The product security device of claim 1, wherein the pivot member is configured to engage the sensor only when the pivot member is in the deflected position.

14. The product security device of claim 1, further comprising an arming switch configured to transition the product security device between an armed state and an unarmed state;

wherein, in response to being in the unarmed state, the sensor is deactivated and does not detect when the pivot member is in the deflected position.

15. An apparatus comprising:

a base;

a movable member operably coupled to the base, the moveable member being configured to engage a strap to maintain the moveable member in a non-deflected position;

a biasing member configured to urge the moveable member into a deflected position;

a sensor configured to detect when the moveable member is in the deflected position, wherein the sensor is configured to, in response to detecting that the moveable member is in the deflected position, generate an alert signal; and processing circuitry configured to receive the alert signal and, in response to receiving the alert signal, transmit an alert triggering signal to initiate an alert.

16. The apparatus of claim 15, further comprising a sounder, and wherein the processing circuitry configured to transmit the alert triggering signal includes being configured to transmit the alert triggering signal to the sounder to cause the sounder to generate an audible sound.

17. The apparatus of claim 15, wherein the movable member is configured to engage the sensor only when the movable member is in the deflected position.

18. The apparatus of claim 15, further comprising an arming switch configured to transition the apparatus between an armed state and an unarmed state;

wherein, in response to being in the unarmed state, the sensor is deactivated and does not detect when the movable member is in the deflected position.

19. A method comprising:

physically receiving a strap affixed to a product onto a pivot member via a sliding action to deflect the pivot member, against the urging of a biasing member, into a non-deflected position, the pivot member being disposed between the strap and a surface of the product;

moving the pivot member into a deflected position and into operable engagement with a sensor in response to the urging of the biasing member and a reduction in a tension on the strap;

detecting, by the sensor, that the pivot member has moved into the deflected position and transmitting an alert signal;

receiving, by the processing circuitry, an alert signal from the sensor; and transmitting an alert triggering signal to initiate an alert.

20. The method of claim 19 wherein transmitting the alert triggering signal includes transmitting the alert triggering signal to a sounder to cause the sounder to generate an audible sound.

* * * * *